US011882924B2

(12) United States Patent
Watzinger

(10) Patent No.: US 11,882,924 B2
(45) Date of Patent: Jan. 30, 2024

(54) HOLDING DEVICE FOR PORTABLE EQUIPMENT ITEMS

(71) Applicant: REELOQ GMBH, Graz (AT)

(72) Inventor: Lukas Watzinger, St. Pantaleon (AT)

(73) Assignee: REELOQ GMBH, Graz (AT)

( * ) Notice: Subject to any disclaimer, the term of this patent is extended or adjusted under 35 U.S.C. 154(b) by 404 days.

(21) Appl. No.: 17/281,981

(22) PCT Filed: Oct. 1, 2019

(86) PCT No.: PCT/AT2019/060321

§ 371 (c)(1),
(2) Date: Apr. 1, 2021

(87) PCT Pub. No.: WO2020/069545

PCT Pub. Date: Apr. 9, 2020

(65) Prior Publication Data

US 2021/0368969 A1 Dec. 2, 2021

(30) Foreign Application Priority Data

Oct. 4, 2018 (AT) ..... A 60165/2018
Jan. 21, 2019 (AT) ..... A 50042/2019

(51) Int. Cl.
*A45F 5/00* (2006.01)
*B65H 75/44* (2006.01)

(52) U.S. Cl.
CPC ..... *A45F 5/004* (2013.01); *B65H 75/4434* (2013.01); *A45F 2200/0533* (2013.01)

(58) Field of Classification Search
CPC ..... A45F 5/004; A45F 2200/0516; A45F 2200/0533; A45F 2200/0541; B65H 75/4434
See application file for complete search history.

(56) References Cited

U.S. PATENT DOCUMENTS 5,918,658 A * 7/1999 Schartner ..... E06B 9/30 242/385.2
8,371,486 B2 * 2/2013 Imafuku ..... A45F 5/004 224/258
9,079,747 B2 * 7/2015 Huang ..... B65H 75/4431
11,026,502 B1 * 6/2021 Erold ..... A45F 5/004
2005/0072819 A1 * 4/2005 Maldonado ..... A45F 5/004 224/269
2009/0084697 A1 * 4/2009 Gross ..... A45F 5/004 206/316.1

* cited by examiner

*Primary Examiner* — Sang K Kim
(74) *Attorney, Agent, or Firm* — Maschoff Brennan

(57) ABSTRACT

A holding device for cameras or other portable equipment includes a housing in which a roller element and a return element are arranged. The roller element is rotatably mounted in relation to the housing. A tie for fastening equipment items is completely rolled up on the roller element in an initial state, with only one end thereof protruding from the housing. The return element exerts a tensile force on the roller element so that the tie can be rolled up on the roller element. The tie is unrolled and pulled out of the housing when an external tensile force larger than the tensile force of the return element is exerted on the tie. The tie is rolled up to the initial state into the housing when an external tensile force smaller than the tensile force of the return element is exerted on the tie.

19 Claims, 7 Drawing Sheets

A-A

A-A

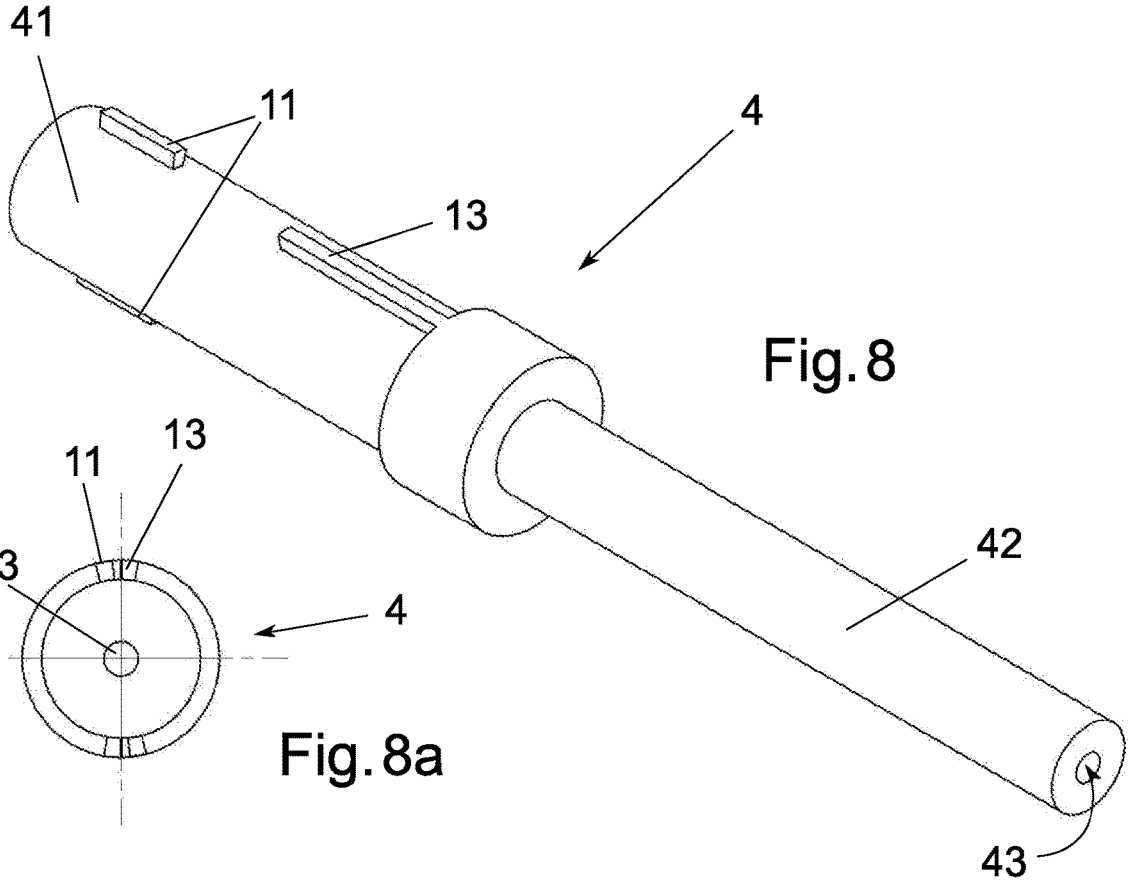
Fig. 8
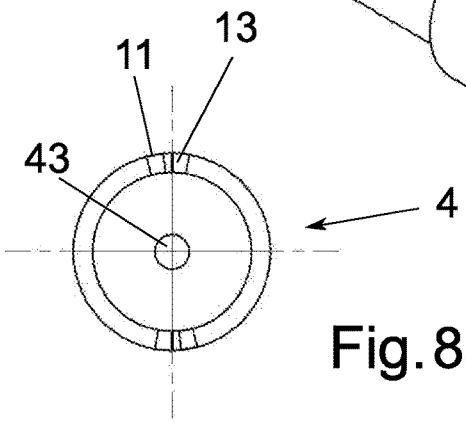
Fig. 8a
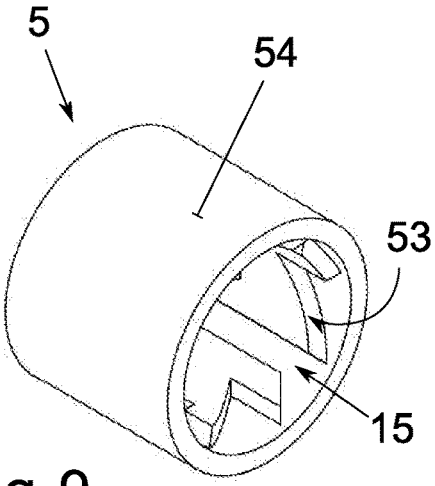
Fig. 9
Fig. 9a
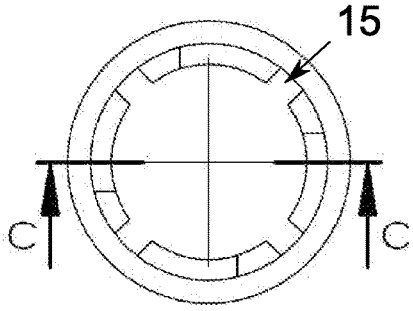
C-C
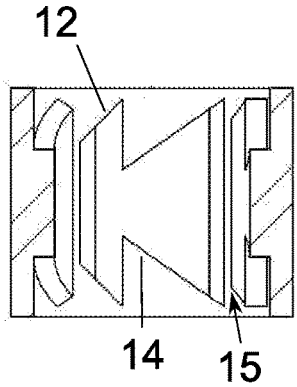
Fig. 9b

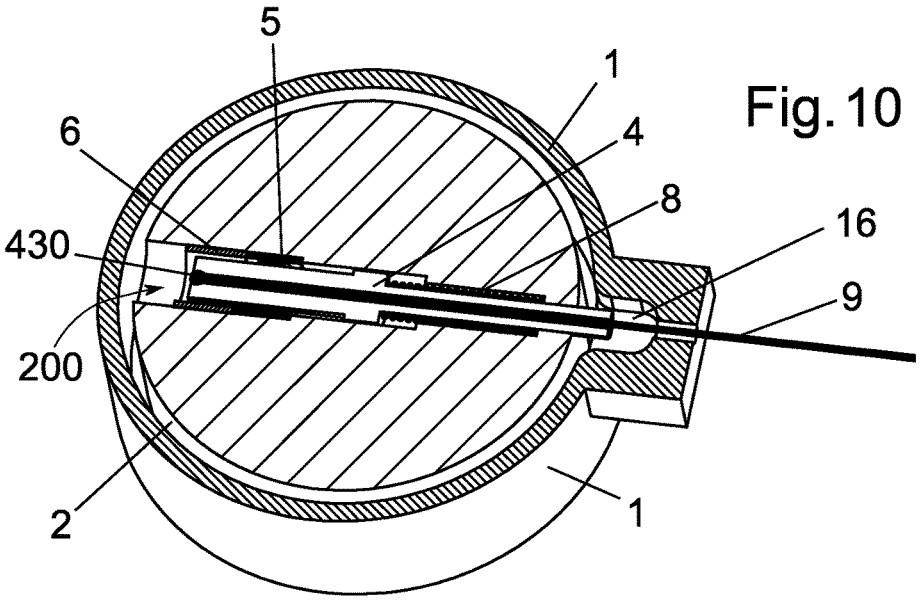
Fig. 10
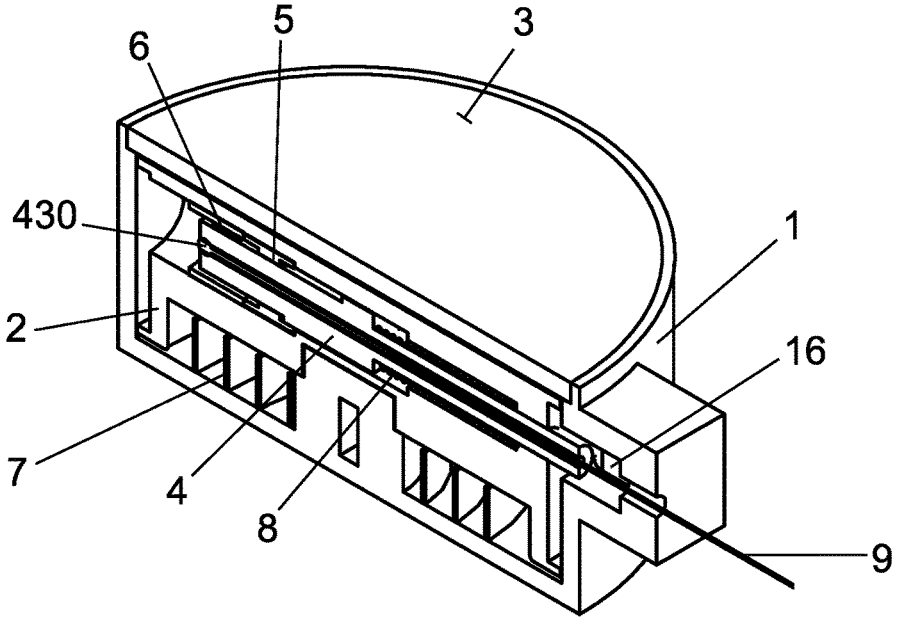
Fig. 11
Fig. 12
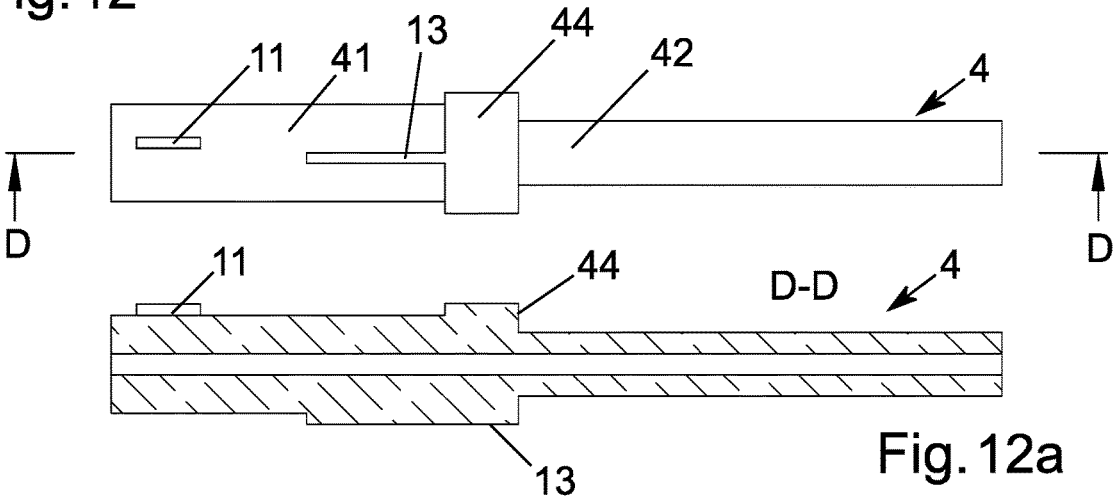
Fig. 12a

HOLDING DEVICE FOR PORTABLE EQUIPMENT ITEMS

The invention refers to a holding device for portable equipment, in particular cameras, according to the generic term of the patent claim 1.

In many cases, it is desirable to have portable equipment within easy reach on the user. Especially in the outdoor area, e.g. when hiking or climbing, it is advantageous to have equipment such as smartphones, cameras or binoculars immediately within reach. In extreme operational situations, it is also helpful for the involved firefighters, paramedics or police officers to be able to act quickly and efficiently if the equipment items, such as radios, are quickly within reach and securely attached to the body of the person in question.

In the prior art, extendable holding devices are known, for example, from US 2018/0070705 A1 or EP 2189079 A1, which ensure that the equipment cannot be lost as it is attached to the holding device by means of a cord or rope. In order to use the equipment, the user grasps it and pulls it away from the holding device, whereby the cord rolled up in the housing of the holding device rolls out. In the housing of such holding devices, components which exert a return effect on the cord as soon as it is pulled out are installed, so that it rolls up again automatically. However, this kind of force transmitted to the equipment via the cord can be disturbing when using the equipment.

It is therefore the object of the invention to provide a holding device for portable equipment, which enables a user to use the equipment attached thereto, without the equipment being subjected to forces which interfere with use.

The invention solves this issue by means of a holding device for portable equipment, in particular cameras, comprising

- a housing in which a roller element and a return element are arranged, wherein the roller element is arranged on the housing and is rotatably mounted in relation to the housing,
- a tie for fastening equipment items, wherein the tie is completely rolled up on the roller element in an initial state and only one end of the tie protrudes from the housing,
- wherein the return element is arranged between the housing and the roller element in such a way that the return element exerts a tensile force on the roller element so that the tie can be rolled up on the roller element,
  - wherein the tie can be unrolled and can be pulled out of the housing in relation thereto when a tensile force facing away from the housing is exerted on the tie, a force which is greater than the force exerted by the return element on the roller element, up to an end position in which the tie is completely unrolled from the roller element (2), and
  - wherein the tie can be rolled up to the initial state and can be pulled out of the housing in relation thereto when a tensile force facing away from the housing is exerted on the tie, a force which is smaller than the force exerted by the return element on the roller element, having the distinguishing features of the patent claim 1.

According to the invention, it is provided that the holding device comprises a bistable locking mechanism which has two switching positions, namely a locked position and an unlocked position,

- wherein in the locked position the rotation of the roller element in relation to the housing is blocked and the tie is rolled off by at least 80%, in particular by 80 to 99%, preferably by 95 to 99%,
- wherein in the unlocked position the roller element is rotatable in relation to the housing and
- whereby the locking mechanism can be changed between the locked position and the unlocked position, in each case by bringing the tie in the end position.

The design of the holding device with a bistable locking mechanism ensures advantageously that the items of equipment can be used without disturbing tensile forces acting on them when the locking mechanism is in the locked position. In addition, such a design of the locking mechanism ensures that it is only locked in the end position, which allows the greatest possible range of movement when using the equipment items.

When the locking mechanism is in the unlocked position, a tensile force is exerted on the roller element by the return element and the tie is rolled up on the roller element and retracted into the housing. Thereby, the locking mechanism is switched from the locked position into the unlocked position and vice versa, from the unlocked position into the locked position, when the tie is brought into the end position.

This design of the locking mechanism as a bistable locking mechanism ensures advantageously that the equipment, such as a camera, is safely stored within reach of the user in the initial state of the tie. In order to use the equipment, the user pulls on the tie until it is in the end position and the equipment can be used without tensile forces acting on it. If the equipment is to be stored again, the user pulls the tie again, until it is in the end position, the tie is rolled up and the equipment is again safely stored on the holding device.

A particularly simply constructed locking mechanism can be provided, if the locking mechanism comprises a cylinder, a piston and a spring element,

- wherein it is provided in particular that the cylinder, the piston and the spring element are arranged preferably in the center, in the roller element,
- wherein the longitudinal axes of the cylinder, the piston and the spring element are coaxial and form a common longitudinal axis,
- wherein the cylinder is mounted in the roller element in a non-displaceable manner along the common longitudinal axis, and wherein the first front end of the cylinder faces the roller element and the second front end faces the piston,
- wherein the piston is mounted in the roller element in a non-displaceable manner along the common longitudinal axis, and exhibits an extension section and a spring section, wherein the extension section and the spring section are separated from each other, in particular by a shoulder,
- wherein the spring element is in particular placed on the shoulder and surrounds, at least partially, the spring section and
- wherein one end of the tie is attached to the piston and the other end of the tie is guided through an opening in the roller element and through a recess in the housing.

A locking mechanism constructed this way goes advantageously by with a small number of individual components, which can, for example, be manufactured cost-efficiently from plastic and produced in different sizes, in order to be able to use them in holding devices of different sizes.

Pistons and cylinders which are particularly cost-effective in terms of production can be provided if at least two pairs of extensions are arranged on the piston, wherein the two pairs of extensions are spaced apart from one another along the common longitudinal axis, and the cylinder is rotatable around the common longitudinal axis and exhibits sawtooth-like cams arranged on its two front ends, which are interrupted by a number of grooves running in the direction of the common longitudinal axis, wherein the cams and the grooves interact with the pairs of extensions in such a way that when the tie is adjusted into the end position, the locking mechanism is switched between the locked position and the unlocked position respectively.

A particularly compact design of the piston and the cylinder can be ensured, if at least one rear pair of extensions is arranged on the extension section of the piston at its end remote from the spring section and at least one front pair of extensions is arranged on its end close to the spring section, and the cylinder exhibits rear cams arranged in the initial area of its front end facing the roller element and front cams arranged in the initial area of its front end facing the piston.

An easy adjustment of the locking mechanism from the unlocked position to the locked position and from the locked position to the unlocked position can be ensured, if when the tie is adjusted into the end position, the rear cams interact with the rear pair of extensions in such a way that the piston rotates around the common longitudinal axis and the front pair of extensions is pressed into the front cams of the cylinder by the action of the elastic force exerted on the piston by the spring element, so that the locking mechanism is switched into the locked position and the spring section of the piston plunges into a recess in the housing and a rotation of the roller element in relation to the housing is impeded, and when the tie is adjusted again in the end position, the rear cams interact with the rear pair of extensions in such a way that the cylinder rotates around the common longitudinal axis and, due to the action of the elastic force exerted by the spring element on the piston, the front pair of extensions plunges into the grooves of the cylinder, so that the locking mechanism is switched to the unlocked position and the spring section of the piston is pulled out from the recess in the housing and the roller element can be rotated in relation to the housing.

A structurally simply constructed, material-saving design of a locking mechanism can be provided, if the cylinder is designed as a hollow cylinder and the cams are arranged on the inside of the wall surface of the cylinder, wherein the pairs of extensions are arranged on the outside of the piston, and wherein the cylinder and the piston are designed such that the piston can at least partially move in the cylinder.

A further manufacturing-advantageous design of a locking mechanism can be provided, if the piston is formed at least partially as a hollow cylinder and the pairs of extensions are arranged on the inside of the wall surface of the piston and the cams are arranged on the outside of the cylinder, and wherein the cylinder and the piston are designed such that the piston can at least partially move over the cylinder, so that the cylinder is at least partially included in the interior of the piston.

A particularly effective locking of the locking mechanism in the locked position, namely a simple switching of the locking mechanism between the unlocked position and the locked position and vice versa can be achieved, if the two extensions of each pair of extensions are radially opposite to each other on the piston.

A damage caused to the sawtooth-like cams can advantageously be prevented, if the pairs of extensions have slopes corresponding to the sawtooth-like cams, which slide along the sawtooth-like cams when the tie is switched to the end position.

In order to ensure a particularly compact design of the cylinder, it can be provided that the ends of the sawtooth-like cams each face the end faces of the cylinder and extend at most up to the end face of the cylinder.

A particularly simple and stable fixing of the tie to the piston can be achieved, if the piston is completely penetrated by a longitudinally extended channel, whereby the tie is guided through the channel and is fixed at the end of the piston that is remote from the recess in the housing, with a particularly spherical locking element.

In order to be able to fix various types of portable equipment to the holding device, it can be provided that an adapter for fixing portable equipment, in particular a camera, is arranged on the end of the tie that is guided out of the housing.

This design of the holding device makes it advantageously possible to arrange a suitable adapter on the holding device for a wide variety of portable equipment, so that the objects can be easily attached to and removed from the holding device. Such an adapter can also be designed in such a way that it can be replaced.

Particularly effective return and spring elements respectively can be provided, if the return element is designed as a spiral spring or torsion spring and/or the spring element as a pressure spring. By selecting the return element this way, a long storage life of the holding device can be achieved, without the return element showing signs of fatigue, for example, so that the tie is rolled up flawlessly on the roller element during the entire service life of the holding device. The design of the spring element as a pressure spring advantageously ensures a compact, space-saving design of the locking mechanism.

A particularly compact and constructively simply designed holding device can be provided, if the housing exhibits a cover, whereby the roller element is fixed by the cover against a displacement in the direction of the rotation axis of the roller element.

Further advantages and designs of the invention shall result from the description and the accompanying drawings.

The invention is illustrated schematically by means of particularly advantageous, but not limitative examples of embodiments in the drawings, as follows, and is described by way of example with reference to the drawings.

The following is shown:

Figure 4:
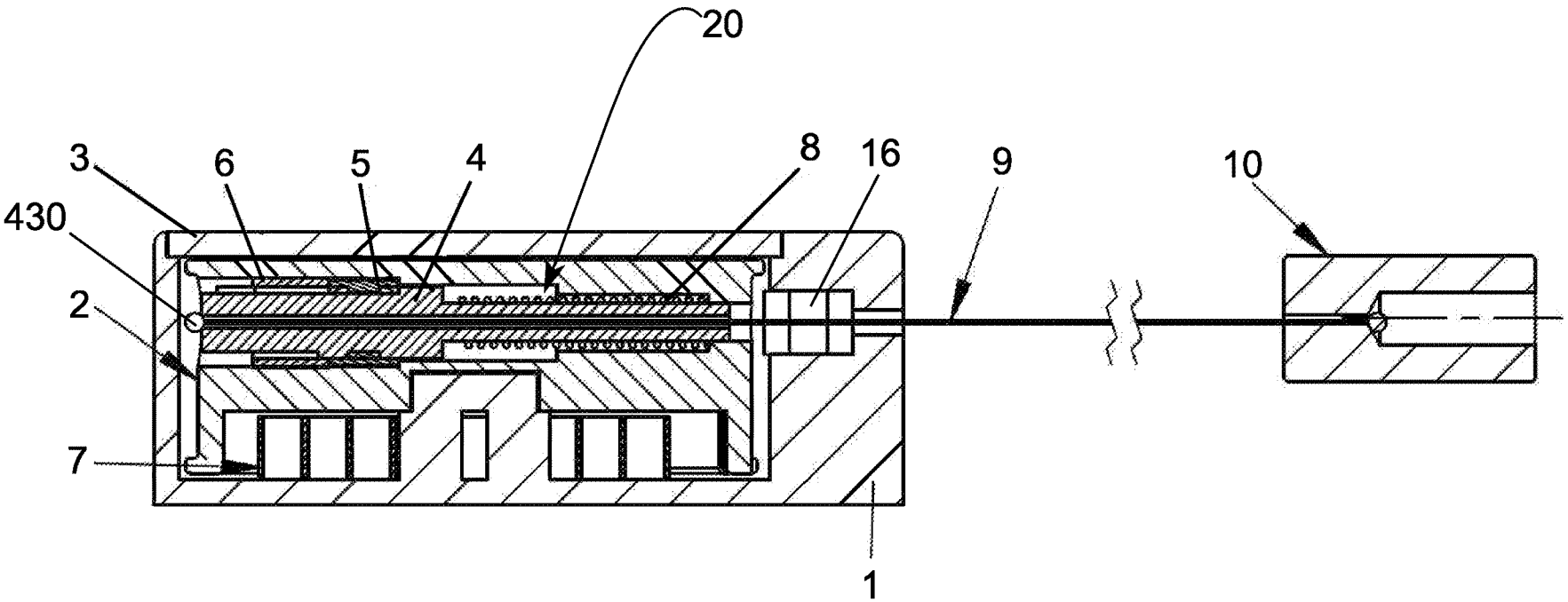
Figure 5:
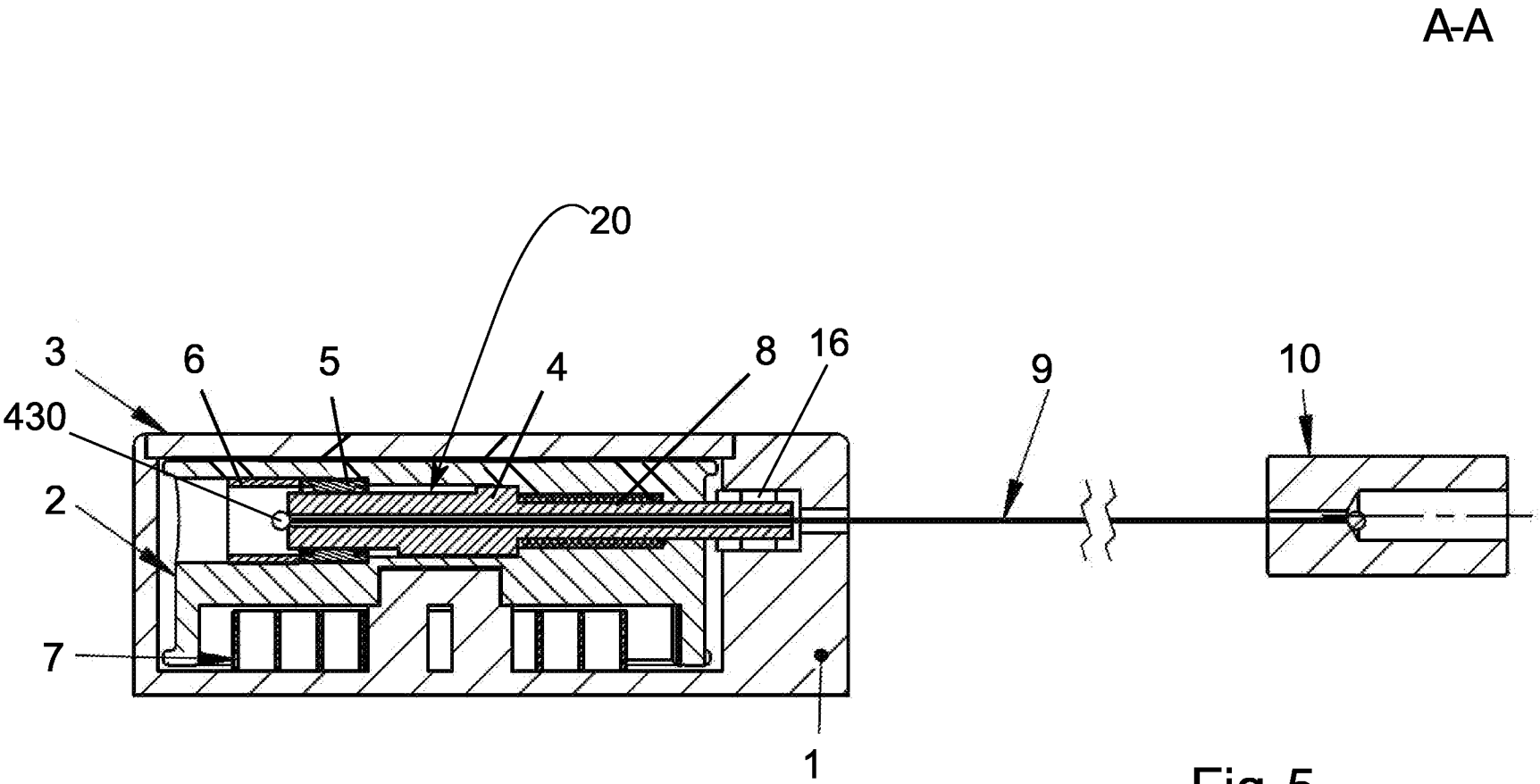
Figure 6:
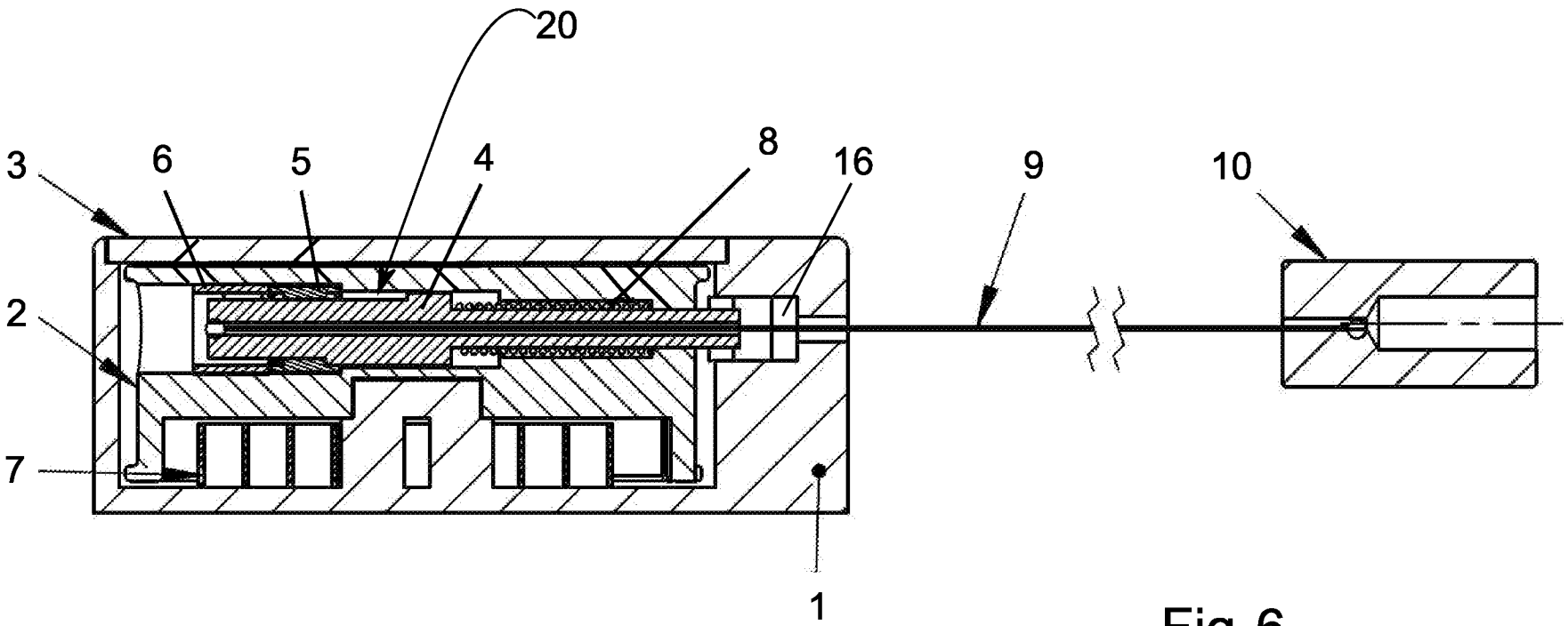
Figure 7:
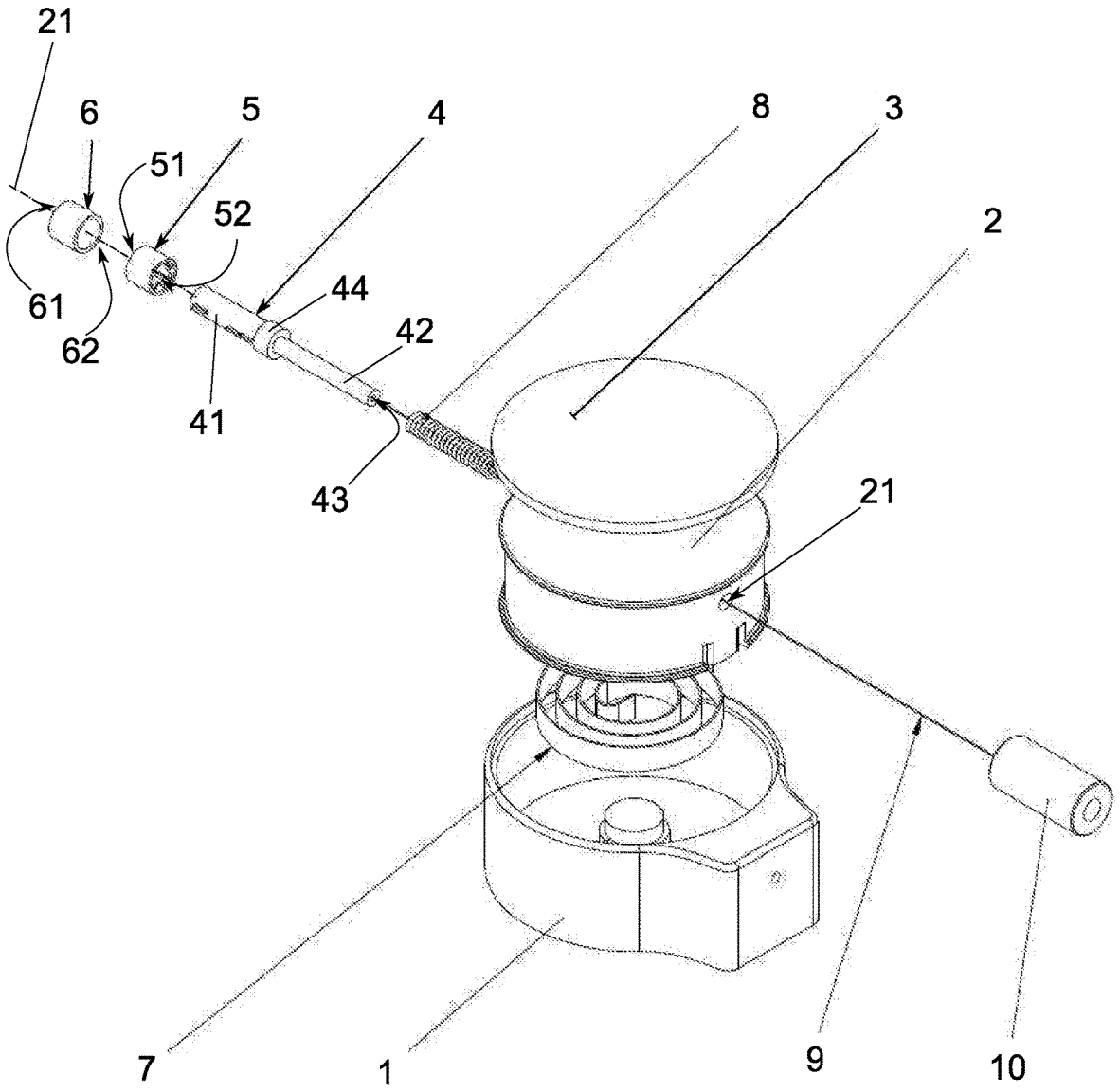

FIG. 4 shows a sectional view with the locking mechanism in the unlocked position, FIG. 5 shows a sectional view through the locking mechanism of the first embodiment with the tie in the end position, FIG. 6 shows a sectional view through the first embodiment with the locking mechanism in the locked position, FIG. 7 shows an exploded view of the first embodiment, FIG. 8 shows an example of embodiment of a piston according to the invention, FIG. 8*a* shows a sectional view through the extension section of the piston from FIG. 8, FIG. 9 shows an oblique view of an embodiment of a cylinder according to the invention, FIG. 9*a* shows a radial sectional view through the cylinder from FIG. 9, FIG. 9*b* shows an axial sectional view through the cylinder from FIG. 9, FIG. 10 shows a further sectional view through the first embodiment, FIG. 11 shows a further sectional view through the first embodiment, FIG. 12 shows a detailed view of the piston from FIG. 8, FIG. 12*a* shows a sectional representation through the piston from FIG. 12.

Figure 1:
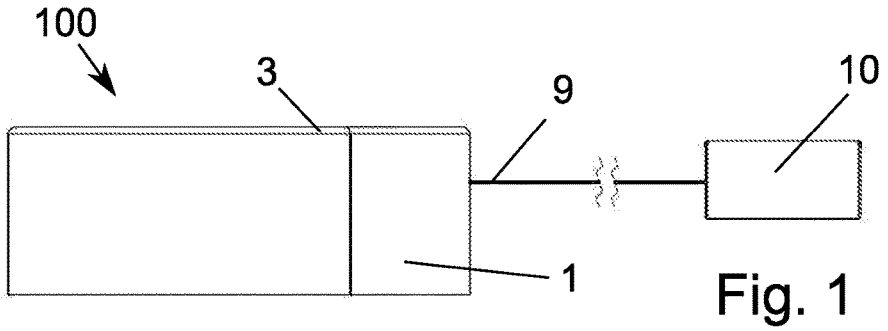
FIG. 1 shows an outline of a first embodiment of the invention.
Figure 2:
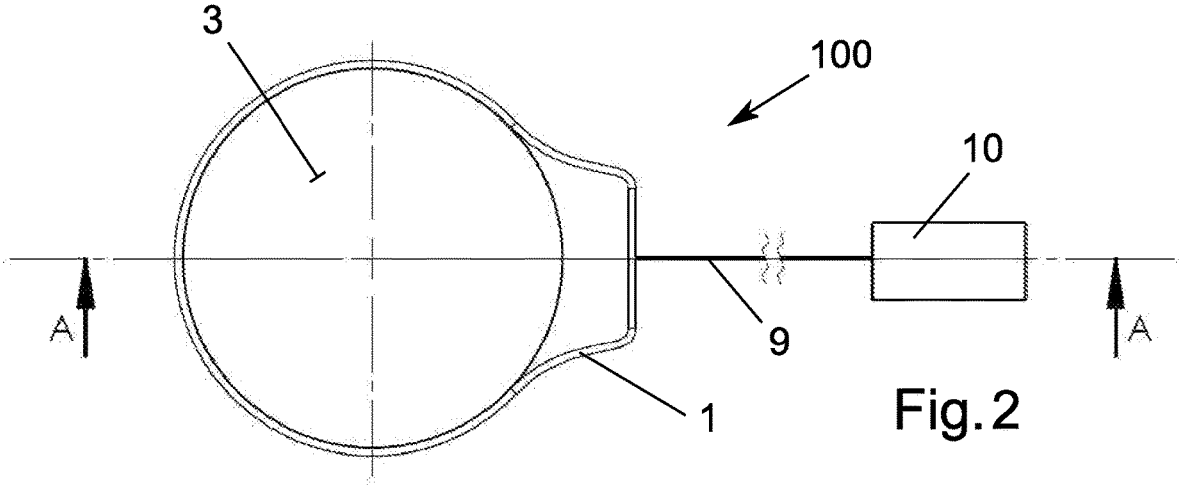
FIG. 2 shows a top view of the first embodiment.
Figure 3:
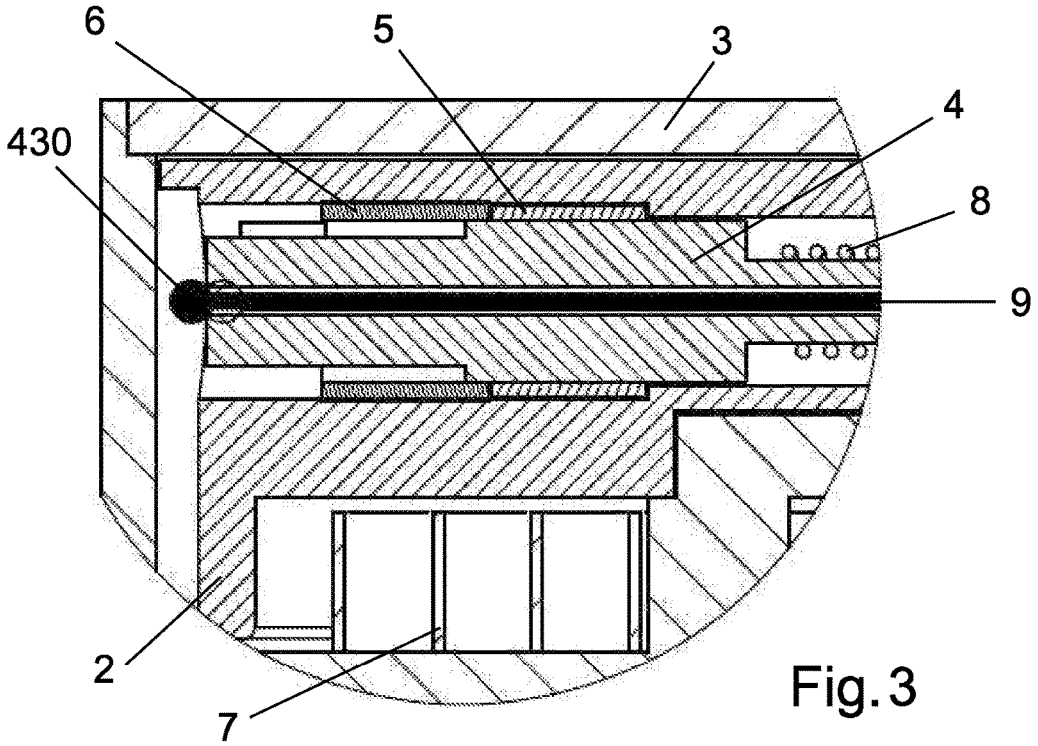
FIG. 3 shows a detailed section of a detailed view of the first embodiment.

FIG. 1 and FIG. 2 show a first embodiment of a holding device 100 according to the invention, viewed from the outside. As it can be seen in FIGS. 1 and 2, the holding device 100 comprises a housing 1, from which one end of a tie 9 is led through. The equipment items to be stored are attached to this end.

Optionally, as shown in FIGS. 1 and 2, the holding device 100 may comprise a cover 3 and/or an adapter 10, which is attached to the end of the tie 9, which protrudes from the housing 1. Such an adapter 10 can be used particularly to secure the fixing of portable equipment items, such as cameras, and can be designed to be interchangeable, whereas for a wide variety of objects a suitable adapter 10 is attached to the end of the tie 9 that protrudes from the housing 1.

As it can be seen in particular in FIG. 3 to FIG. 7, FIG. 10 and FIG. 11, the holding device 100 further comprises in the first embodiment a roller element 2 and a return element 7, which are arranged in the housing 1. The roller element 2 is rotatably mounted on the housing 1 in relation to the housing 1, which can be achieved, for example, by means of a radial bearing formed on the inside of the housing, as it is represented, for example, in FIG. 4 to FIG. 7.

The tie 9 whose one end protrudes from the housing 1 and is used for fastening items, is completely rolled up on the roller element 2 in an initial state. In the shown embodiment, the tie 9 is thus rolled up on the outer circumference on the roller element 2.

The return element 7 is arranged between the housing 1 and the roller element 2 and exerts a tensile force on the roller element 2, so that the tie 9 is rolled up on the roller element 2 in its initial state. In the shown embodiment, the return element 7 is a spiral spring that fixes to the bearing on which the roller element 2 rests, on the one hand, and to the inside of the wall surface of the roller element 2, on the other. However, the return element 7 is by no means necessarily designed as a spiral spring, it can also be designed, for example, as a torsion spring or as another return element known from the prior art.

Due to the action of the force exerted by the return element 7 on the roller element 2, the tie 9 is independently rolled up, at least partially, for example on the outer circumference of the roller element 2, if a tensile force acts on the tie 9, which is smaller than the tensile force exerted by the return element 7 on the roller element 2. Within the context of the invention, the initial state is understood to occur when the tie 9 is completely rolled up on the roller element 2 and only one end of the tie 9 protrudes from the housing 1.

If a tensile force acts on the tie 9, which is directed away from the housing 1 and is greater than the force exerted by the return element 7 on the roller element 2, the tie 9 can be rolled off to an end position and moved away from the housing 1, namely pulled out of the housing 1. Within the context of the invention, the end position (see FIG. 5) is understood to occur when the tie 9 is completely rolled off from the roller element 2 and pulled out of the housing 1.

In order to prevent an equipment item attached to the tie 9 from being constantly subjected to a tensile force caused by the return element 7 via the tie 9, when the item is being used by the user and the tie 9 is not in its initial state, a holding device 100 according to the invention comprises a bistable locking mechanism 20. Within the context of the invention, a bistable locking mechanism 20 is understood to mean a locking mechanism, which has two switching positions, namely a locked position (see FIG. 6) and an unlocked position (see FIG. 4). Except for these two stable positions, the locking mechanism 20 has no other stable position.

The locking mechanism 20 is represented in detail in FIGS. 3 to 6. When the locking mechanism 20 is in the locked position (see FIG. 6), the rotation of the roller element 2 in relation to the housing 1 is blocked and the tie 9 is at least 80% rolled off from the roller element 2. Optionally, in all embodiments of a holding device according to the invention, the tie 9 may be 80 to 99% or 95 to 99% drawn out in the locking position.

When the locking mechanism 20 is in the unlocked position (see FIG. 4), the roller element 2 can rotate in relation to the housing 1 and the tie 9 is rolled up on the roller element 2 when no tensile force that exceeds the force of the return element 7 is applied to it.

The locking mechanism 20 can be changed between the two stable switching positions by means of bringing the tie 9 into the end position. This means that the locking mechanism 20 is changed from the locked position to the unlocked position, for example, when the tie 9 is brought into the end position. In the unlocked position of the locking mechanism 20, the tie 9 can be pulled out of the housing 1 and a rotation of the roller element 2 in relation to the housing 1 is possible. If the tie 9 is now brought again into the end position, the locking mechanism 20 is changed from the unlocked position to the locked position.

For this purpose, the locking mechanism 20 may have a movable element, such as a locking element, which can be moved, namely shifted in the locking mechanism 20, namely in the roller element 2. The tie 9 may be attached to one end of the locking element and guided out of the housing 1. The locking mechanism 20 can be changed between the two stable switching positions, by means of moving the tie 9 in the end position. When the locking mechanism is brought into the locked position, the locking element plunges at least partially in the housing 1, for example in a recess 16 in the housing 1, so that the rotation of the roller element 2 in relation to the housing 1 is blocked in the locked position. If the locking mechanism is brought into the unlocked position, the locking element is moved out of the housing 1, e.g. out of a recess 16 in the housing 1, back into the roller element 2 and a rotation of the roller element 2 in relation to the housing 1 is possible in the unlocked position.

If a user switches the locking mechanism 20 into the locked position, the user can use an equipment item fixed to the holding device 100, e.g. a camera, without any disturbing forces acting on it. Should the camera accidentally fall out of the user's hand during use, the tie 9 is extended to its end position by the weight of the camera. If the reset force exerted by the return element 7 on the tie 9 exceeds the weight of the fixed equipment item, the locking mechanism 20 is switched in the unlocked position and the camera is pulled towards the holding device 100, by means of independently rolling up the tie 9 on the roller element 2. Optionally, therefore, in all embodiments of a holding device 100 according to the invention, the return element 7 can be matched to the weight of an equipment item, so that the equipment item adjusts the locking mechanism 20 into the unlocked position when it falls down and is pulled towards the holding device 100.

In the shown embodiment, the locking mechanism 20 is arranged in the center in the roller element 2 in a recess 430 of the roller element 2. Alternatively, the locking mechanism 20 can be arranged eccentrically, for example on the housing 1 or in the roller element 2. The locking mechanism 20 can therefore optionally also be arranged differently, as long as a locking effect of the relative movement can be achieved between the housing 1 and the roller element 2.

The locking mechanism 20, namely its mode of operation, are shown in detail in FIGS. 3 to 6. In the shown embodiment, the locking mechanism 20 (see FIG. 7) comprises a cylinder 5, a piston 4 and a spring element 8, which are arranged coaxially in the roller element 2, namely in a recess 200 of the roller element 2 and exhibit a common longitudinal axis 21.

Thereby, the cylinder 5 is mounted inside the roller element 2 in such a way that it can rotate around the common longitudinal axis 21, however it cannot be moved along the longitudinal axis 21. The cylinder 5 has two front ends 51, 52, the first front end 51 of the cylinder 5 facing the roller element 2 and the second front end 52 facing the piston 4. The piston 4 is mounted in the roller element 2 in a displaceable manner, along the common longitudinal axis 21 and exhibits an extension section 41 and a spring section 42. The extension section 41 and the spring section 42 can be separated from each other, for example, by a shoulder 44.

The spring element 8, which in the first embodiment for example is a pressure spring, surrounds at least partially the spring section 42 of the piston 4 and may rest on the shoulder 44 of the piston 4. That end of the tie 9, which is located in the housing 1, is attached to the piston 4, while the other end of the tie 9 is guided out of the housing 1 through an opening 21 in the roller element 2 and through a recess 16 in the housing 1.

Optionally, the piston 4 for fixing the tie 9 can, for example, be completely penetrated by an elongated channel 43 (see FIG. 8), the tie 9 being guided through the channel 43. At that end of the piston 4, namely of the channel 430, which is located inside the roller element 2 and is remote from the recess 16 in the housing 1, the tie 9 can be fixed with a in particular spherical locking element 430. Alternatively, however, there are other ways possible to attach the tie 9 to the piston 4, e.g. by gluing.

In order to mount the cylinder 5 so that it can rotate around the common longitudinal axis 21, but so that it cannot be moved along the common longitudinal axis 21, a sleeve 6, for example, as shown in FIGS. 3 to 6, can be arranged between the roller element 2 and the cylinder 5. In the shown embodiment, the sleeve 6 is arranged by gluing it to the roller element 2, so as to be rigid in terms of movement and rotation. One front end 61 of the sleeve 6 faces the roller element 2 and a second front end 62 of the sleeve 6 is in contact with the first front end 51 of the cylinder 5. The sleeve 6 thus serves as a spacer for the cylinder 5, but does not limit its rotability around the common longitudinal axis 21.

In the first embodiment, the piston 4 (see FIGS. 8, 8*a*, 12, 12*a*) exhibits two pairs of extensions 11, 13 which are arranged on the piston 4 at a distance one from each other along the common longitudinal axis 21. Alternatively, however, more than two pairs of extensions 11, 13 may be arranged on the piston 4. In the embodiment shown, the pairs of extensions 11, 13 are arranged on the extension section 41 of the piston 4. Thereby, a rear pair of extensions 11 is arranged on the extension section 41 at its end remote from the spring section 42 and a front pair of extensions 13 is arranged at its end close to the spring section 42.

In the first embodiment (see FIG. 8*a*), the two extensions of each pair of extensions 11, 13 are radially opposite to each other on the piston 4. This means that both extensions of each pair of extensions 11, 13 are arranged in an offset manner by 180° on the circumference of the piston 4. However, this arrangement of the extensions of the pairs of extensions 11, 13 is by no means mandatory and the extensions can also be arranged at other distances and numbers from each other along the circumference of the piston 4.

As can be seen in FIG. 8*a*, FIG. 12 and FIG. 12*a*, the two pairs of extensions 11, 13 are not completely arranged in an aligned manner with each other on the extension section 41 of the piston 4, but are offset from each other in such a way that one edge of the extensions of one pair of extensions 11 is aligned with one edge of the extensions of the other pair of extensions 13. However, this arrangement is by no means mandatory and the arrangements in which the extensions of the pairs of extensions 11, 13 are radially spaced apart and not aligned are also possible.

As shown in FIGS. 9, 9*a* and 9*b*, the cylinder 5 exhibits sawtooth-like cams 12, 14 arranged on its two front ends 51, 52. The cams 12, 14 are interrupted by a number of grooves 15 running in the direction of the common longitudinal axis 21. In the embodiment shown, for example, the rear cams 12 are arranged in the initial region of that front end 51 of the cylinder 5, which faces the roller element 2, and the front cams 14 are arranged in the initial region of the front end 52, which faces the piston 4, as shown in detail in FIG. 9*b*.

As shown in FIG. 9, in the embodiment shown, the ends of the sawtooth-like cams 12, 14 each extend in the direction of the front ends 51, 52 of the cylinder 5, i.e. the ends of the sawtooth-like cams 12, 14 face the front ends 51, 52. Furthermore, the ends of the cams 12, 14 extend maximally to the respective front ends 51, 52 of the cylinder 5. Advantageously, this ensures a particularly material-saving design of the cylinder 5, in which the ends of the sawtooth-like cams 12, 14 are protected from an increased wear. However, this arrangement of the cams 12, 14 is by no means mandatory and the ends of the cams 12, 14 can, for example, also be arranged on the cylinder 5 in such a way that they protrude beyond the front ends 51, 52.

As can be seen in FIG. 5, in the first embodiment, cylinder 5 is designed as a hollow cylinder and the cams 12, 14 are arranged on the inside of the wall surface 54 of the cylinder 5. The pairs of extensions 11, 13 are arranged on the outside of the piston 4 and the piston 4 and the cylinder 5 are designed and dimensioned in such a way that the piston 4 is at least partially movable into the cylinder 5.

In the first embodiment, the sawtooth-like cams 12, 14 are thereby designed to have alternatively inclined planes running in the direction of the ends of the cams 12, 14, followed by longitudinal surfaces running parallel to the common longitudinal axis 21.

In the first embodiment, those ends of the extensions of the pairs of extensions 11, 13 that face, namely interpose with the sawtooth-like cams 12, 14 have slopes corresponding to the cams 12, 14 that slide along the sawtooth-like cams 12, 14. This embodiment of the pairs of extensions 11, 13 advantageously ensures that the ends of the pairs of extensions 11, 13 are worn as little as possible, but this is by no means mandatory. Alternatively, the pairs of extensions 11, 12 can, for example, also exhibit straight running slopes.

The sawtooth-like cams 12, 14 and the grooves 15 of the cylinder 5 interact with the pairs of extensions 11, 13 of the piston 4 in such a way that when the tie 9 is moved to the end position, the locking mechanism 20 is switched between the locked position and the unlocked position. If the locking mechanism 20 is in the unlocked position, as shown in FIG. 4, and the tie 9 is not in the end position, but is partially rolled up on the roller element 2, the tie 9 exerts a force in a radial direction to the common longitudinal axis 21 of the piston 4 and the piston 4 remains inside the roller element 2.

However, when the tie 9 is brought into the end position, i.e. completely rolled off from the roller element 2 and pulled from the housing 1, a tensile force acts in the axial direction on the piston 4 and the rear cams 12 interact with the rear pair of extensions 11 in such a way that the cylinder 5 is rotated around the common longitudinal axis 21 and the front pair of extensions 13 is pressed into the front cams 13 of the cylinder 5 by the action of the elastic force exerted on the piston 4 by the spring element 8. This is shown in detail in FIG. 5. The locking mechanism 20 is thus switched to the locked position and the spring section 42 of the piston 4 thereby plunges into the recess 16 in the housing 1, so that the rotation of the roller element 2 in relation to the housing 1 is impeded.

If the tie 9 is again moved to the end position, the rear cams 12 interact with the rear pair of extensions 11 in such a way that the cylinder 5 is rotated around the common longitudinal axis 21 and, due to the action of the elastic force exerted on the piston 4 by the spring element 8, the front pair of extensions 13 plunges into the grooves 15 of the cylinder 5. In this way, the locking mechanism 20 is moved into the unlocked position (see FIG. 4, FIG. 10) and the spring section 42 of the piston 4 is retracted from the recess 16 in the housing 1. As a result, the roller element 2 can be rotated in relation to the housing 1.

Alternatively to the design of the piston 4 in the first embodiment, the piston 4 may optionally be at least partially designed as a hollow cylinder. For example, the extension section 41 can be designed as a hollow cylinder and the pairs of extensions 11, 13 can be located on the inside of the wall surface of the piston 4. The sawtooth-like cams 12, 14 can be located on the outside of the cylinder 5, whereby the cylinder 5 and the piston 4 are designed and dimensioned in such a way that the piston 4 is at least partially movable over the cylinder 5.

Alternatively to the embodiment of the locking mechanism 20 described in the first embodiment, a holding device 100 according to the invention can comprise any other bistable locking mechanism 20, which has two switching positions and can be switched between the two switching positions by moving the tie 9 into the end position. A large number of locking mechanisms known from the prior art, such as actuating mechanisms for ballpoint pens, have a such mode of operation and can therefore be used as locking mechanism 20 in a holding device 100 according to the invention. In the case of the actuating mechanism of the ballpoint pen, the unlocked position corresponds to the state with the refill retracted, while the locked position in the case of the actuating mechanism corresponds to the state with the refill extended.

By way of example, another such locking mechanism is described below, which is known from the Canadian patent application CA 642639 A. In this case, the locking mechanism has, for example, a cylinder and a piston, which are arranged coaxially in the roller element and have a common longitudinal axis. The cylinder is radially and axially non-displaceably mounted in the roller element and at least one pair of cylinder extensions is arranged on the cylinder, the two extensions of which are radially spaced apart from each other and have inclined slopes.

As in the first embodiment, the piston has an extension section and a spring section surrounded by a spring element. Both sections of the piston are separated by a shoulder and the piston has a pair of extensions, which also have inclined slopes directed in the same direction as the slopes of the pair of cylinder extensions. In this case, the piston is slidably mounted in the roller element along the common longitudinal axis, but cannot rotate around the common longitudinal axis. The tie is arranged on the piston, as in the first embodiment, and the piston is at least partially adjustable into a recess in the housing.

In addition, the locking mechanism in this case has a ring element with sawtooth-like cams that surrounds at least partially the extension section of the piston, so that the axis of the ring element coincides with the common longitudinal axis. The ring element is rotatably mounted in the roller element around the common longitudinal axis and rests on the shoulder. The sawtooth-like cams have at least two locking recesses and at least two unlocking recesses. The locking recesses and the unlocking recesses of the ring element are radially opposite each other on the ring element. The cams of the ring element can be arranged on the inside of the ring element or form the end edge of the ring element facing the piston extension pair and the cylinder extension pair.

The extensions of the cylinder, the piston and the sawtooth-like cams of the ring element interact when the tie is moved to the end position in such a way that the pair of piston extensions presses against the slopes of the sawtooth-like cams of the ring element, so that the ring element is rotated. The slopes of the ring element slide along the slopes of the cylinder, the cylinder extension pair plunges into the locking recesses of the ring element due to the action of the elastic force exerted by the spring element on the piston, and the locking mechanism is switched from the unlocked position to the locked position. The spring section of the piston plunges into a recess in the housing and the rotation of the roller element in relation to the housing is impeded.

By moving the tie to the end position again, the pair of piston extensions is again pressed against the corresponding slopes of the ring element, so that the ring element is rotated again. The contact surfaces of the cams of the ring element slide along the slopes of the cylinder, the cylinder extension pair plunges into the unlocking recesses of the ring element due to the action of the elastic force exerted by the spring element on the piston, and the locking mechanism is switched from the locking position to the unlocking position. The spring section of the piston is retracted from the recess in the housing and the roller element is rotatable in relation to the housing.

In this embodiment of the locking mechanism, the extensions of the cylinder or the extensions of the piston are arranged in such a way that a side face of each extension of the piston slides along a side surface of an extension of the cylinder when the tie is moved to the end position. The sawtooth-like cams of the ring element are designed to correspond to the slopes of the extensions of the piston and the cylinder, i.e. they have corresponding slopes alternating with straight surfaces running parallel to the common longitudinal axis.

Alternatively to this embodiment of the locking mechanism, any other bistable actuation mechanism for ballpoint pens may be used.

In all embodiments of a holding device 100 according to the invention, an adapter 10 for fixing portable equipment can be arranged at that end of the tie 9, which is guided out of the housing 1, as already described before. Such an adapter 10 can advantageously be adjusted to the user, depending on the object that the user wishes to fix to the holding device 100.

Optionally, in all embodiments of the invention, it may also be provided that the housing 1 of the holding device 100 has a cover 3 (see FIG. 11). Such a cover 3, on the one hand, fixes the roller element 2 against the displacement in the direction of the axis of rotation of the roller element 2 and, on the other hand, protects the components of the holding device 100, which are located inside the housing 1, from dirt. Such a housing 1 can, for example, be closed all around, so that the single opening is the recess 16 in the housing 1, through which one end of the tie 9 is guided out of the housing.

The invention claimed is:

1. A holding device for portable equipment, comprising:

a housing in which a roller element and a return element are arranged, wherein the roller element is arranged on the housing and is rotatably mounted in relation to the housing, a tie for fastening equipment items, wherein the tie is completely rolled up on the roller element in an initial state and only one end of the tie protrudes from the housing, and a bistable locking mechanism having a locked position and an unlocked position;

wherein:

the return element is arranged between the housing (1) and the roller element (2) in such a way that the return element exerts a tensile force on the roller element so that the tie can be rolled upon the roller element, the tie can be unrolled and can be pulled out of the housing when a tensile force facing away from the housing is exerted on the tie, a force which is greater than the force exerted by the return element on the roller element, up to an end position in which the tie is completely unrolled from the roller element, the tie can be rolled up to the initial state into the housing when a tensile force facing away from the housing is exerted on the tie, a force which is smaller than the force exerted by the return element on the roller element, in the locked position of the locking mechanism, the rotation of the roller element in relation to the housing is blocked and the tie is rolled off by at least 80%, in the unlocked position of the locking mechanism, the roller element is rotatable in relation to the housing, and the locking mechanism can be changed between the locked position and the unlocked position by placing the tie in the end position, wherein:

the locking mechanism includes a cylinder, a piston and a spring element, the cylinder, the piston and the spring element are arranged in the center of the roller element, longitudinal axes of the cylinder, the piston and the spring element are coaxial and form a common longitudinal axis, the cylinder is mounted in the roller element in a non-displaceable manner along the common longitudinal axis, a first front end of the cylinder faces the roller element, and a second front end faces the piston, the piston is mounted in the roller element in a non-displaceable manner along the common longitudinal axis and exhibits an extension section and a spring section, the extension section and the spring section being separated one from another by a shoulder, the spring element is mounted on the shoulder, and at least partially surrounds the spring section, and one end of the tie is fixed on the piston and the other end of the tie is guided through an opening in the roller element and through a recess in the housing.

2. The holding device according to claim 1, wherein:

at least two pairs of extensions are arranged on the piston, the two pairs of extensions being spaced apart from each other along the common longitudinal axis, the cylinder is rotatable around the common longitudinal axis and exhibits sawtooth-like cams arranged at its two front ends, which are interrupted by a number of grooves running in a direction of the common longitudinal axis, and the cams and the grooves interact with the pairs of extensions in such a way that the tie is adjusted in the end position of the locking mechanism between the locked position and the unlocked position respectively.

3. The holding device according to claim 2, wherein:

the cylinder is designed as a hollow cylinder and the cams are arranged on the inside of the wall surface of the cylinder, the pairs of extensions are arranged on the outside of the piston, and wherein the cylinder, and the piston is designed in such a way that the piston is at least partially movable in the cylinder.

4. The holding device according to claim 2, wherein:

the piston is at least partially formed as a hollow cylinder and the pairs of extensions are arranged on the inside of the wall surface of the piston and the cams are arranged on the outside of the cylinder, and the cylinder and the piston are configured in such a way that the piston is at least partially movable over the cylinder so that the cylinder is at least partially included in the interior space of the piston.

5. The holding device according to claim 2, wherein:

the two extensions of each pair of extensions are radially opposite to each other on the piston, and/or the pairs of extensions exhibit slopes corresponding to the sawtooth-like cams, which slide along the sawtooth-like cams when the tie is switched into the end position.

6. The holding device according to claim 2, wherein the ends of the sawtooth-like cams face individually the end faces of the cylinder and extend at most to the end face of the cylinder.

7. The holding device according to claim 2, wherein:

at least one rear pair of extensions is arranged on the extension section of the piston at its end remote from the spring section and at least one front pair of extensions is arranged at its end close to the spring section, and the cylinder exhibits rear cams arranged in the initial region of the front end facing the roller element and front cams arranged in the initial region of its front end facing the piston.

8. The holding device according to claim 1, wherein:

at least one rear pair of extensions is arranged on the extension section of the piston at its end remote from the spring section and at least one front pair of extensions is arranged at its end close to the spring section, and the cylinder exhibits rear cams arranged in an initial region of the front end facing the roller element and front cams arranged in the initial region of its front end facing the piston.

9. The holding device according to claim 8, wherein:

when the tie is adjusted in the end position, the rear cams interact with the rear pair of extensions in such a way that the cylinder rotates around the common longitudinal axis and the front pair of extensions is pressed into the front cams of the cylinder by the action of the elastic force exerted by the spring element on the piston, so that the locking mechanism is switched in the locked position and the spring section of the piston plunges a recess in the housing and the rotation of the roller element in relation to the housing is impeded, and when the tie is adjusted again in the end position, the rear cams interact with the rear pair of extensions in such a way that the cylinder rotates around the common longitudinal axis and, by the action of the elastic force exerted by the spring element on the piston, the front pair of extensions plunges the grooves of the cylinder, so that the locking mechanism is switched to the unlocked position and the spring section of the piston is pulled out from the recess in the housing and the roller element is rotatable in relation to the housing.

10. The holding device according to claim 8, wherein:

the cylinder is designed as a hollow cylinder and the cams are arranged on the inside of the wall surface of the cylinder, the pairs of extensions are arranged on the outside of the piston, and wherein the cylinder, and the piston is designed in such a way that the piston is at least partially movable in the cylinder.

11. The holding device according to claim 8, wherein:

the piston is at least partially formed as a hollow cylinder and the pairs of extensions are arranged on the inside of the wall surface of the piston and the cams are arranged on the outside of the cylinder, and the cylinder and the piston are configured in such a way that the piston is at least partially movable over the cylinder so that the cylinder is at least partially included in the interior space of the piston.

12. The holding device according to claim 8, wherein:

the two extensions of each pair of extensions are radially opposite to each other on the piston, and/or the pairs of extensions exhibit slopes corresponding to the sawtooth-like cams, which slide along the sawtooth-like cams when the tie is switched into the end position.

13. The holding device according to claim 8, wherein the ends of the sawtooth-like cams face individually the end faces of the cylinder and extend at most to the end face of the cylinder.

14. The holding device according to claim 1, wherein the piston is completely penetrated by a longitudinally extended channel, the tie being guided through the channel and being fixed by a spherical locking element at that end of the piston, which is remote from the recess in the housing.

15. The holding device according to claim 1, wherein an adapter for fixing the portable equipment is arranged at the end of the tie guided out of the housing.

16. The holding device according to claim 1, wherein:

the return element is designed as a spiral spring or torsion spring, and/or the spring element is designed as a pressure spring.

17. The holding device according to claim 1, wherein the housing exhibits a cover, the roller element being fixed by the cover against the displacement in the direction of the rotation axis of the roller element.

18. The holding device according to claim 1, wherein:

the locking mechanism comprises a locking element which is movable in at least one of the locking mechanism or the roller element, the tie is attached to one end of the locking element and is guided out of the housing, in the locked position of the locking mechanism, the locking element plunges at least partially into a recess in the housing, so that the rotation of the roller element in relation to the housing is blocked, and in the unlocked position of the locking mechanism, the locking element is displaced out of the recess in the housing, back into the roller element, so that the roller element is rotatable in relation to the housing.

19. The holding device according to claim 1, wherein an adapter for fixing the portable equipment is arranged at the end of the tie guided out of the housing.

* * * * *